United States Patent [19]

Juba

[11] 4,128,981

[45] Dec. 12, 1978

[54] BURIAL VAULT

[75] Inventor: Bernard T. Juba, White Bear Lake, Minn.

[73] Assignee: H.B. Fuller Company, St. Paul, Minn.

[21] Appl. No.: 770,633

[22] Filed: Feb. 22, 1977

[51] Int. Cl.[2] ..... E04B 13/00

[52] U.S. Cl. ..... 52/309.3; 52/309.17; 52/128; 156/333

[58] Field of Search ..... 52/309.3, 309.17, 135, 52/128, 139, 334, 335; 264/256; 156/333, 335

[56] References Cited

U.S. PATENT DOCUMENTS

| | | | |
|---|---|---|---|
| 3,439,461 | 4/1969 | Chandler | 52/139 |
| 3,605,366 | 9/1971 | Zakim | 52/309.17 |
| 3,619,457 | 11/1971 | Chandler | 264/256 |
| 3,775,240 | 11/1973 | Harvey | 52/309.17 |

FOREIGN PATENT DOCUMENTS

| | | | |
|---|---|---|---|
| 1153589 | 8/1963 | Fed. Rep. of Germany | 427/403 |
| 1228056 | 4/1971 | United Kingdom. | |

OTHER PUBLICATIONS

Engineer's Handbook of Adhesive by Aitken Published by Machinery Publishing Co., pp. 46–49, 1972.

*Primary Examiner*—John E. Murtagh
*Attorney, Agent, or Firm*—Norman P. Friederichs

[57] ABSTRACT

A burial vault is provided including concrete wall portions and a plastic resinous liner. The liner is adhered to the wall portions, at the time of pouring the concrete, utilizing contact adhesive preferably polychloroprene cement. The vault may include adhesive coated reinforcement.

12 Claims, 5 Drawing Figures

BURIAL VAULT

BACKGROUND OF THE INVENTION

The present invention relates to burial vaults and more particularly to concrete burial vaults having plastic liners.

Burial vaults of concrete construction have been known and used in the past. Early embodiments of such concrete burial vaults were made of single wall reinforced concrete having an asphalt inner liner. A common problem encountered with such concrete burial vaults was infiltration of moisture through the porous concrete walls. Such infiltration is produced by hydrostatic pressure in the grave.

Subsequently, burial vaults constructed of concrete walls and plastic resinous liners were developed as illustrated in U.S. Pat. No. 3,439,461 and U.S. Pat. No. 3,787,545. A difficulty encountered in the production of plastic lined burial vaults is that of lack of proper adhesion between the concrete component and the plastic liner. The two mentioned patents seek to solve the adhesion problem utilizing a wet, tacky adhesive such as epoxy resin. These patents show applying the tacky adhesive coating to the plastic liner, disposing the plastic liner in a suitable mold form and then pouring wet-mix flowable concrete into the mold form in contact with the coated liner. The wet-mix concrete and the wet tacky adhesive coating are cured simultaneously to effect an integral bond between the plastic liner and the concrete wall. The wet tacky adhesive is indicated to intermingle with the wet concrete while forming the adhesion.

Certain significant problems are encountered in such production of burial vaults. The described epoxy requires two components which cannot be mixed until shortly before construction of the burial vault. Once the epoxy components are mixed, curing begins. Therefore, time is limited during which the plastic liner and concrete may be combined. Also, handling problems are encountered due to the wet, tacky character of the epoxy.

GENERAL DISCUSSION OF THE PRESENT INVENTION

In the present invention, it was discovered that a single component adhesive (i.e. neoprene-phenolic adhesive cement) may be utilized in construction of plastic lined burial vaults. As used herein the term "single component adhesive" means an adhesive that may be formulated and remain stable even though it is not immediately used. In the present invention, dry-to-the-touch adhesives may be applied to a plastic lining, the lining may be placed in a suitable mold form and wet-mix flowable or pourable concrete placed into the mold to form the walls of a burial vault. It was unexpectedly discovered that the dry-to-the-touch adhesive provides a strong bond between the lining and the cured concrete. It was further discovered that such adhesives may be used to coat the reinforcing material, such as metal rod, to produce a strong bond between such metal reinforcing and the concrete walls and/or the plastic lining. This bonding permits placement of the reinforcement at any location within the poured concrete. For example, the reinforcement may be placed where it is most needed such as along the inner surface just beneath the plastic liner. The present invention provides a burial vault of improved strength due to the bond between the concrete, liner and reinforcing material. It has been found that the present adhesive bond between the film and the concrete withstands temperature cycles far greater than those typically encountered by burial vaults. The present method provides improved efficiencies due to lower materials cost, reduced labor costs and improved quality control.

The present invention provides a burial vault constructed from wet, flowable concrete and plastic lining. The concrete may be any suitable mix of heavy or lightweight aggregate and Portland cement. Typically, the concrete mix will provide concrete having a compression strength of not substantially less than 4500 p.s.i. (pounds per square inch). However, in some instances, one may use concrete of less compression strength particularly if the present reinforcing is included. The concrete mix will further include water in an amount sufficient to provide a flowable mixture. The burial vault may be formed in the desired shape utilizing a mold. The preformed plastic lining may serve as a portion of the mold. The plastic lining may be of any plastic sheet material and desirably is preformed such as by vacuum molding. The plastic material may be of the type described in U.S. Pat. Nos. 3,439,461 and 3,787,545. The plastic lining has a contact adhesive applied to the inner surface thereof. The plastic liner may be of any suitable plastic sheet material, preferably polystyrene. Other plastic sheet materials include polyvinyl chloride, ABS (acrylonitrile butadiene styrene), styrene and acrylic. The plastic liner may be any other plastic sheet material. The plastic liner may typically have a thickness of at least about 0.02 inches.

The adhesive may be any dry-to-the-touch adhesive which will bond both to the plastic sheet material and to the wet poured concrete. The adhesive preferably is a polychloroprenephenolic resin adhesive.

The contact adhesive of the present invention may be a polychloroprene cement. Polychloroprene cements generally are known, see British Pat. No. 1,228,056. Polychloroprene cements may be prepared by dissolving polychloroprene in a suitable solvent and compounding the dissolved neoprene with a phenol formaldehyde resin and various alkaline earth oxides such as zinc oxide or magnesium oxide.

Polychloroprene, as used herein, means polymerized chloroprene and copolymers of chloroprene with minor amounts of other monomers such as isoprene, butadiene, acrylonitrile and the like. The polychloroprene may be polymerized 2-chloro-1,3-butadiene having a molecular weight on the order of 100,000 to 300,000. One suitable type is Neoprene type W TM. The polychloroprene may be in the form of an elastomer blend including 2 to 40 percent halogenated butyl rubber and 98 to 60 percent polychloroprene.

The phenol formaldehyde resin may be prepared from monohydric phenols having only two reactive sites. Such resins may be prepared by reacting a para-substituted alkyl phenol with at least a 1:1 ratio of formaldehyde to phenol in the presence of an alkaline catalyst. The ratio of aldehyde to phenol is typically in the range of 1.2:1 to 1.6:1. A suitable phenol formaldehyde resin is a product of Union Carbide Corporation having the designation CK-1634.

Solvents suitable for preparation of the contact adhesive are C6–C10 hydrocarbons including aromatics such as benzene, as well as, toluene, xylene and hexane blends thereof, chlorinated hydrocarbons and petroleum solvents containing high percentages of aromatic and naphthenic constituents. Blends of napthas and ketones or esters may also be used. Preferred solvents include toluene and 1,1,1-trichloroethane.

The ratio of polychloroprene to phenolic resin may be 0.5:1 to 2.5:1. The alkaline earth oxide may be included in an amount of 5 to 30 parts per hundred parts polychloroprene. The alkaline earth oxide may be prereacted in solution with the resin together with a small amount of water. The solvent may be present in the contact adhesive in an amount sufficient to permit application of the adhesive to the plastic sheet. Various modifications may be made in composition of the adhesive so long as the adhesive produces a strong bond between the cured, wet-poured concrete and the plastic sheet.

An illustrative adhesive includes a blend of halogenated butyl rubber (i.e. polychloroprene), an alkaline earth metal oxide, a heat reactive phenol formaldehyde resin (or a terpene/phenolic resin) and an inert solvent. The adhesive may be provided as a liquid or solution including phenolic resin. The adhesive includes sufficient solvent to enable application of the adhesive to the liner.

One suitable liquid adhesive has been prepared by dissolving 5.91 parts t-butyl phenolic resin and 0.35 parts magnesium oxide in 17.64 parts 1,1,1-trichloroethane and then adding 0.09 parts water. As used herein, the terms parts, percent and the like will designate parts, percent and the like by weight unless otherwise indicated. Next, 50.08 parts 1,1,1-trichloroethane is added along with 8.82 parts polymerized 2-chloro-1,3-butadiene with 0.18 parts antioxidant. Finally, 16.93 parts perchlorethylene is added.

Such an adhesive has been found to provide excellent adhesion and any failure has occurred within the concrete mass rather than between the adhesive and the concrete mass. Of course, various other contact adhesives may be used.

IN THE DRAWINGS

DETAILED DISCUSSION OF THE PRESENT INVENTION

Figure 1:
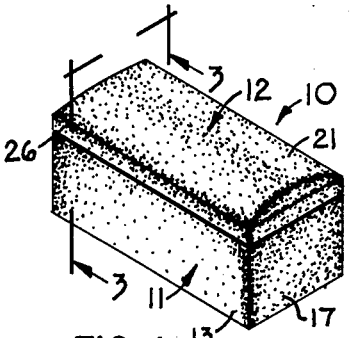
FIG. 1 shows a perspective view of a burial vault of the present invention.
Figure 2:
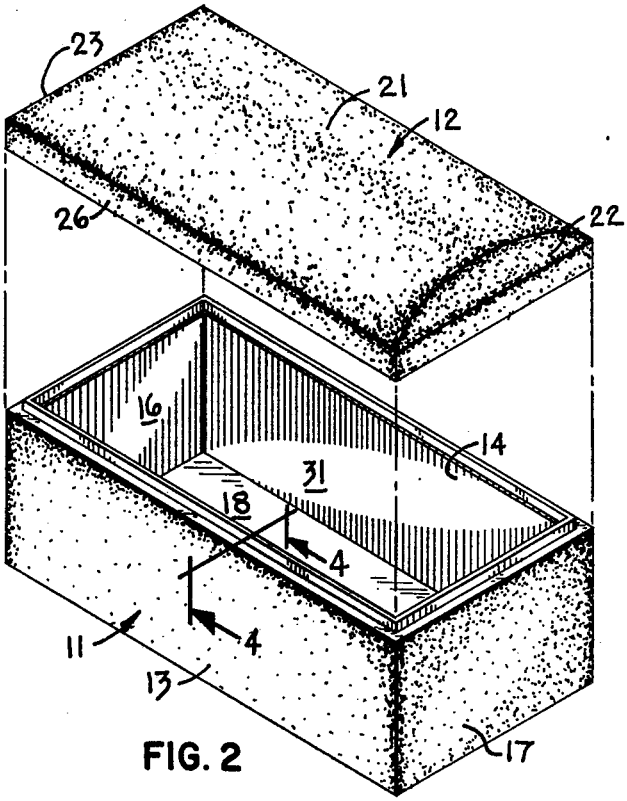
FIG. 2 is an exploded perspective view of the present burial vault.
Figure 3:
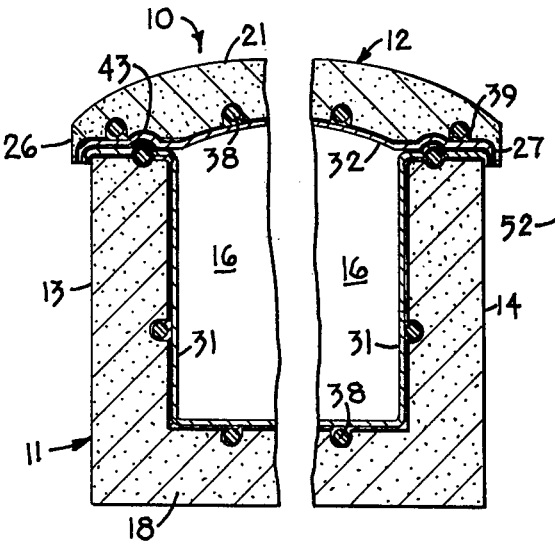
FIG. 3 is a cross-sectional view taken along the lines 3—3 in FIG. 1.

The burial vault 10 of the present invention, one embodiment of which is shown in FIGS. 1–3, may include a bottom portion or base member 11 and a upper portion or lid member 12. The base member 11 may be constructed having a pair of elongated side walls 13 and 14, a pair of end walls 16 and 17, and a bottom wall 18. The lid member 12 may include a dome-shaped top wall 21, a pair of end walls 22 and 23 and a pair of side walls 26 and 27.

The base member 11 and the lid member 12 each include a plastic liner 31 and 32, respectively. The liner 31 may be a preformed, vacuum molded wall unit of synthetic plastic resinous material. The resinous liner material may be polystyrene, polyvinyl chloride, ABS, polyester resin, butadiene-styrene or butadiene-acylonitrile and may be a continuous film. Likewise, the lid liner 32 may be a continuous film of such plastic resinous material.

Various methods may be used to shape the liner. The preferred approach is called bubble vacuum molding. A sheet of plastic, for example, having a thickness of about 0.180 inches, is stretched over a mold form. The plastic is warmed until it becomes softened and pressure in exerted to blow a bubble. Then vacuum is drawn to pull the bubble into the mold and the plastic is again permitted to become rigid. The molded plastic desirably has a thickness of at least 0.020 inches. The edges are trimmed such as by die cutting. The liner 31 and the liner 32 each may provide a sealed surface within the bottom member 11 and lid member 12, respectively. The liner 31 and the liner 32 are each held in place with respect to the concrete using a contact adhesive which bonds to both the liner and the wet concrete.

Figure 4:
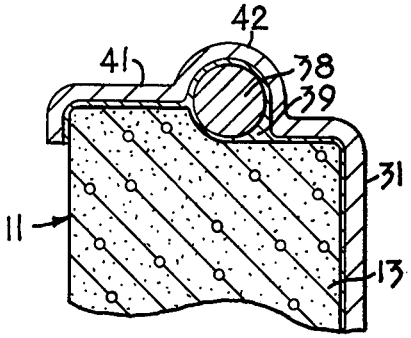
FIG. 4 is an enlarged cross-sectional view taken along the lines 4—4 in FIG. 2.

The vault 10 may include various reinforcements for purposes of strengthening the walls and resisting distortion. The present vault preferably includes reinforcement such as bar 38 shown in FIG. 4, which are disposed within the concrete but immediately beneath the film. The reinforcement may be deformed reinforcing bars. The metal reinforcement bar 38 are coated with the contact adhesive 39 and may be disposed in zones where the greatest strength is needed. Adhesive coated steel or other reinforcement members may be prebonded to the shaped liner prior to placement of the wet concrete. The contact adhesive adequately bonds the reinforcing member to the liner and no additional fixturing or holding device is required to maintain the reinforcing member in the desired position during subsequent manufacturing operations including the placement of the wet-mix concrete. Following pouring of the concrete, the metal reinforcement will be actually bonded to the concrete by the contact adhesive.

The metal reinforcement provides greater green strength to the vault which is important if the vault is to be moved following the initial curing of the concrete. For example, the vault while still green may be moved from the mold to a storage area where final curing takes place. The metal reinforcing also provides greater stiffness and flexural strength even after the concrete is fully cured. This is of advantage to prevent sidewall movement during high pressure loading such as in triple depth internment where hydrostatic pressure may exceed 6 p.s.i.g. Sidewall movement is undesirable since it may produce failure of the seal between the bottom portion and the upper portion. Sidewall movement may result in cracking of the sidewall concrete and in turn water leakage. In the present invention, the metal reinforcement may be located in the area of greatest stress which generally is at the inner surface of the walls.

Various approaches may be followed for sealing between the lid member 12 and the base member 11. For example, the upper edge 41 of the base 11 may include a tongue 42 for engagement in a groove 43 in lid 12. Moreover, a sealant may be disposed in groove 43 to provide a waterproof seam between lid 12 and base 11. Various modifications may be made to the vault without departing from the broader scope of the present invention. For example, the vault may be provided with an outer plastic wall.

Figure 5:
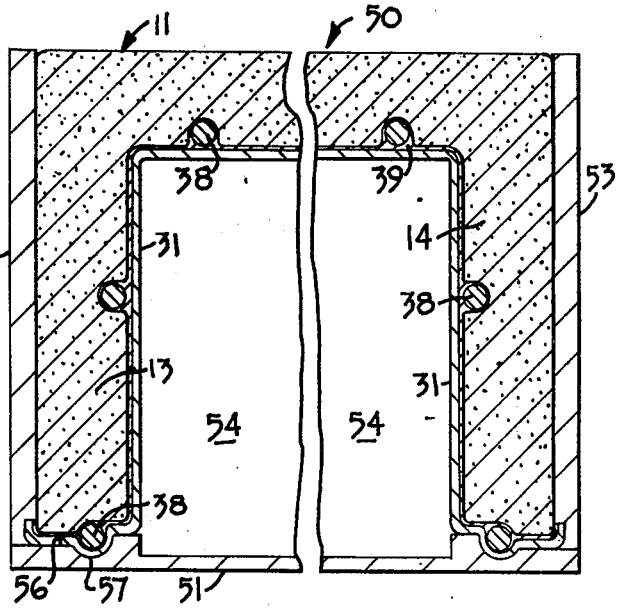
FIG. 5 is a cross-sectional view of the lower portion of the present burial vault while disposed in a mold.

Apparatus suitable for manufacturing the burial vault of the present invention is disclosed in FIG. 5. The apparatus 50 includes a mold having a bottom plate 51 and four side plates such as 52 and 53. The mold further may include a central rectangularly-shaped portion 54.

The portion 54 may be integral with the bottom plate 51; whereas, the side plates such as 52 and 53 desirably are removable for purposes of removing the burial vault from the mold. The lower plate 51 may include a surface shaped to provide the desired contour for the upper edge 41 of the vault sidewalls such as 13 and 14 and in particular providing the tongue 42.

The present invention provides a method for producing burial vaults. The method includes forming a shaped plastic film, applying a contact adhesive to one surface of the film, disposing the film in a mold, pouring wet flowable concrete into the mold in contact with the adhesive.

Various approaches may be used to shape the plastic film; however, the preferred approach is by bubble vacuum molding. Using such approach, a sheet of film is supported over a mold. The sheet is heated until it becomes moldable. Positive gaseous pressure is then applied to the sheet to blow a bubble. A vacuum is next drawn and the bubble is pulled into the vacuum mold and cooled until it becomes rigid. The film is molded in the shape of the inner surface of the desired burial vault. Such vacuum molds are conventional and are not described in detail herein. The vacuum mold is not to be confused for the vault mold 50. The edges of the shaped film or liner may be trimmed by die cutting. The trim may be reformed into sheet for later produced liners.

The shaped plastic film may be placed into the mold 50 in such a manner as to cover the mold central portion 54 and peripheral surface 56. The plastic film is positioned with the finished surface toward the mold portions 54 and 56. Contact adhesive is provided on the side of the film facing away from such mold portions. The contact adhesive may be applied to the film prior to or after placement of the film in the mold 50. The adhesive preferably is applied by paint roller or spraying the adhesive onto the film. The adhesive may be any contact adhesive which will provide the necessary bond to both the plastic film and to the concrete or in other words bond the film to the wet poured concrete.

The contact adhesive may be applied at a wet film thickness of at least 0.002 inches and generally less than 0.010 inches. The wet film thickness will typically be about 0.006 to 0.008 inches. This means that a gallon of adhesive will cover about 200 square feet of liner. Desirably, the adhesive is applied to the entire liner surface which is to be in contact with the concrete.

The mold side plates such as 52 and 53 are mounted and secured to mold portion 51. A wet flowable concrete mixture is prepared and poured into the mold 50 substantially filling such mold. Preferably, the mold is mounted on a vibrator which is in operation during the pouring of the concrete thereby reducing or eliminating bubbles and voids in the concrete. The concrete may be screeded off once the mold is filled thus removing excess concrete. In other words, the exposed surface of concrete is troweled to provide a uniform vault bottom wall. The concrete may have a compressive strength of 4500 p.s.i. or greater and may be conventional construction concrete.

Reinforcement may be placed in the mold prior to or after placement of the concrete in the mold. The reinforcement desirably is coated with the contact adhesive. For example, a peripheral reinforcing rod 38 (FIG. 5) may be placed in the liner immediately after placement of the plastic film in the mold. The adhesive may bond the reinforcing rod to the liner. Rod 38 may lie in the channel 57 of shaped surface 56.

The concrete is permitted to set and cure until the burial vault member is capable of being handled. The burial vault may then be removed from the mold and placed in a storage area while the concrete completes the curing process. The base member 11 and the lid member 12 may be each made in substantially identical manner.

Several suitable adhesives have been prepared and are described in the following examples which are included for purposes of illustration.

EXAMPLE 1

A plastic covered concrete structure was prepared according to the present invention by preparing a contact adhesive and applying such adhesive to a shaped plastic film. The shaped plastic was placed in a mold and then wet mixed concrete was poured into the mold in association with the contact adhesive coating of the plastic film. The contact adhesive was prepared by combining, by weight, 17.64 parts 1,1,1-trichloroethane (chlorothene), 5.91 parts heat reactive t-butyl phenolic resin (a product of Union Carbide Corporation sold under the designation CK-1634), and 0.35 magnesium oxide (a product of Morton Chemical Company sold under the trademark Elastomag 170). Then 0.09 parts water were added with mixing until reaction took place. 50.08 parts 1,1,1-trichloroethane were added with mixing. Next polymerized 2-chlorobutadiene-1,3 (Neoprene type W) and 0.18 parts antioxidant (zinc dibutyldithiocarbamate, a product of Pennsalt Chemicals Corporation sold under the trademark Butyl Ziram) were added and dissolved. Finally 16.93 parts perchlorethylene were added and intimately mixed. An oil soluble red dye was added for purposes of coloring the contact adhesive. The adhesive was applied to polystyrene sheet in an amount of approximately 0.006 inches. The adhesive was applied by brushing. The adhesive following application was dry-to-the-touch. The coated film was then placed in a mold and wet concrete was poured thereon. The concrete was permitted to cure and the polystyrene film was found to be strongly adhered to the concrete by the adhesive. The product was subjected to a plurality of freeze-thaw cycles by raising the temperature to 100° F. and then lowering the temperature to a −40° F. The film remained bonded to the concrete. The product was found to be highly satisfactory.

EXAMPLE 2

A structure was prepared according to the present invention by first preparing contact adhesive. The contact adhesive was prepared by adding 10.24 parts t-butyl phenolic resin and 0.61 parts magnesium oxide to 15.29 parts toluene. Then 0.15 parts acetic acid were added and thoroughly mixed. Toluene in an amount of 10.7 parts was added and blended in. Polymerized 2-chlorobutadiene-1,3 in an amount of 15.29 parts, antioxidant in an amount of 0.31 parts and titanium dioxide in an amount of 1.53 parts were added and dissolved. The adhesive was applied to a polystyrene film and the adhesive immediately became dry to the touch. The coated film was placed in a mold form and freshly mixed concrete was poured into the mold in contact with the adhesive coated side of the film. The concrete was permitted to cure and a strong bond was obtained between the film and the concrete.

EXAMPLE 3

A structure was prepared according to the present invention substantially as described in Example 2, however, the adhesive was prepared by adding 7.45 parts polymerized 2-chlorobutadiene-1,3 and 0.45 parts magnesium oxide to 11.12 parts toluene. Water in an amount of 0.11 parts was added with mixing. Toluene in an amount of 23.66 parts was added with blending. Next 42.83 parts lactol spirits (a solvent sold by American Mineral Spirits Company under the designation AMSCO Lactol Spirits W-1) was added. Polymerized 2-chlorobutadiene-1,3 in an amount of 11.12 parts, chlorinated isoprene (a product of Hercules sold under the trademark Parlon S-20) in an amount of 2.23 parts, antioxidant (a product of E. I. Dupont DeNemours and Company sold under the trademark of Zalba Special) in an amount of 0.22 parts and titanium dioxide (a product of American Cyanamid Company sold under the trademark of Unitane OR-600) in an amount of 1.11 parts were added. This contact adhesive provided an excellent bond between wet poured concrete and a plastic film.

EXAMPLE 4

Two sets of plastic covered concrete structures were prepared according to the present invention substantially as described in Example 1 except the plastic film was ABS. A control of similar construction was prepared except it did not include a plastic sheet or film. The structures were prepared for purposes of testing flexural strength. The structures were rectangular in shape and suitable for testing flexural strength. The structures were each 3 inches by 4 inches by 16 inches. Set IV-A was a control and did not include the surface sheet. Set IV-B was identical to Set IV-A except provided with a sheet of ABS (acrylonitrile butadiene styrene) having a thickness of 0.16 centimeters. The adhesive formula was as described in Example I. Set IV-C was identical to set IV-B except further including standard ½ inch diameter steel reinforcing bars which were bonded to the ABS sheet with adhesive prior to pouring the concrete. The bars were centered on the ABS sheet and spaced 2 inches on center. The bars also were coated with the adhesive. Each of the sets was tested for flexural strength by supporting the individual sample on a pair of fulcrums. Each sample was loaded at the midpoint between the pair of fulcrums to determine the flexural strength. The results were as shown in the following Table

TABLE

BEAM FLEXURAL STRENGTH TEST

| Beam construction | Number of Beams in the Set | Average Flexural Strength | Percent Improvement |
|---|---|---|---|
| Set IV-A (control-all concrete) | 6 | 309 p.s.i. | — |

TABLE-continued

BEAM FLEXURAL STRENGTH TEST

| Beam construction | Number of Beams in the Set | Average Flexural Strength | Percent Improvement |
|---|---|---|---|
| Set IV-B (ABS faced) | 3 | 706 p.s.i. | 228 |
| Set IV-C (ABS faced and reinforced) | 3 | 4,384 p.s.i. | 1,418 |

This testing shows that burial vaults prepared according to the present invention including adhesive bonded plastic lining alone or together with adhesive bonded reinforcing bars would possess substantially improved flexural strength over all concrete burial vaults.

What is claimed is:

1. A method for preparing a composite wall burial vault member including a plastic resinous liner bonded to concrete wall means, said method comprising: applying a contact adhesive layer to one side of a plastic resinous vault liner, said contact adhesive being a polychloroprene adhesive, drying said adhesive to the touch, disposing said plastic resinous liner in a form retaining mold, said plastic liner being disposed with the contact adhesive layer facing away from said mold; pouring wet settable concrete in said mold, said concrete engaging said adhesives and setting and curing said concrete.

2. The method of claim 1 wherein said contact adhesive comprises a phenolic resin and polychloroprene.

3. The method of claim 2 wherein said phenolic resin is t-butyl phenolic resin.

4. The method of claim 1 wherein said plastic resinous liner comprises a polystyrene film.

5. The method of claim 2 wherein reinforcement means are bonded to said liner by contact adhesive prior to pouring said concrete.

6. The method of claim 5 wherein said reinforcement means are coated with contact adhesive.

7. A composite wall burial vault member comprising plastic resinous liner, concrete wall means and a contact adhesive, said contact adhesive being a polychloroprene adhesive, said contact adhesive providing a bond between said liner and said wall means.

8. The burial vault member of claim 7 wherein said plastic liner is coated on one side with said contact adhesive, said adhesive is permitted to dry to the touch and wherein said coated liner and said concrete are brought together while said concrete is in a wet, pourable, uncured condition.

9. The burial vault members of claim 7 wherein said vault includes metal reinforcement, said metal reinforcement being bonded to said concrete by contact adhesive.

10. The burial member of claim 9 wherein said metal reinforcement is also bonded to said liner.

11. The burial vault member of claim 7 wherein said contact adhesive comprises a dry-to-the-touch adhesive.

12. The burial vault member of claim 7 wherein said contact adhesive comprises a phenolic resin and polychloroprene.

* * * * *

UNITED STATES PATENT AND TRADEMARK OFFICE

CERTIFICATE OF CORRECTION

PATENT NO. : 4,128,981

DATED : December 12, 1978

INVENTOR(S) : Bernard T. Juba

It is certified that error appears in the above-identified patent and that said Letters Patent are hereby corrected as shown below:

IN THE SPECIFICATION:

Column 4, line 7, change "in" to --is--.
Column 4, line 24, change "bar" to --bars--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*